United States Patent [19]

Bell

[11] 4,256,361

[45] Mar. 17, 1981

[54] BATTERY POST CLAMP MEMBER

[76] Inventor: Joseph P. Bell, Rte. 1, Box 262D, Grayslake, Ill. 60030

[21] Appl. No.: 57,591

[22] Filed: Jul. 16, 1979

[51] Int. Cl.[3] ..... H01R 4/48

[52] U.S. Cl. ..... 339/228; 339/255 P

[58] Field of Search ..... 339/228, 255 P, 260, 339/261; 24/137 A, 253

[56] References Cited

U.S. PATENT DOCUMENTS

| | | | |
|---|---|---|---|
| 2,602,105 | 7/1952 | Welch | 339/228 |
| 3,267,452 | 8/1966 | Wolf | 339/228 |

FOREIGN PATENT DOCUMENTS

| | | | |
|---|---|---|---|
| 1400116 | 4/1965 | France | 339/228 |
| 731906 | 6/1955 | United Kingdom | 24/137 A |

OTHER PUBLICATIONS

Scientific American; Feb. 11, 1911; "A Simple and Adaptable Form of Electrical Contact"; W. P. White.

*Primary Examiner*—John McQuade

*Attorney, Agent, or Firm*—Hill, Van Santen, Steadman, Chiara & Simpson

[57] ABSTRACT

A spring actuated battery clamp having a pair of cooperable clamp members disposed in side-by-side relation, one of which is adapted to be connected to the end of a battery cable, and utilizing a torsion spring to provide the clamping forces and at the same time maintain the clamping members in assembled relation, means being provided for maintaining the members in alignment with the resulting assembly being inexpensive to manufacture and at the same time providing good clamping characteristics.

4 Claims, 6 Drawing Figures

FIG. 1
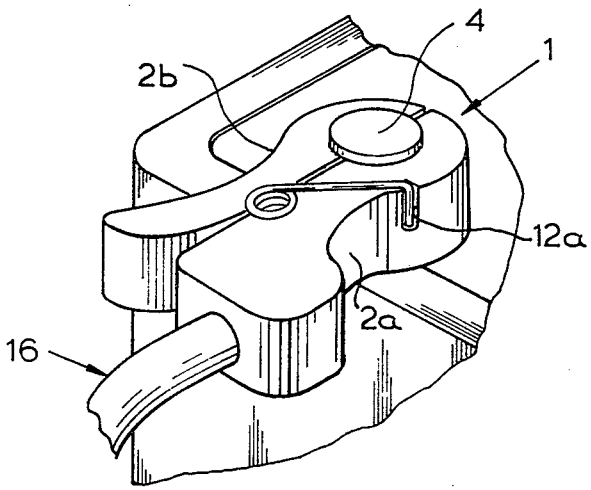
FIG. 3
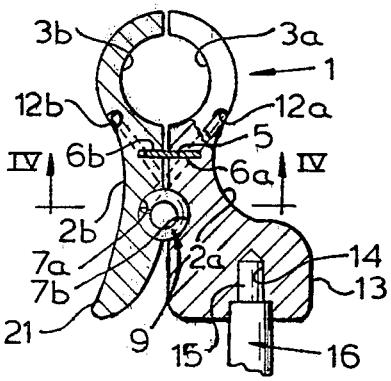
FIG. 2
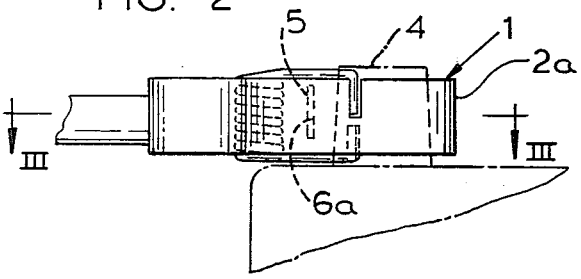
FIG. 4
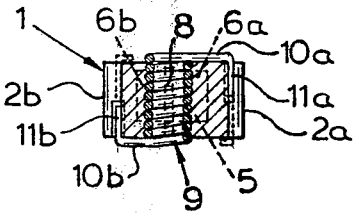
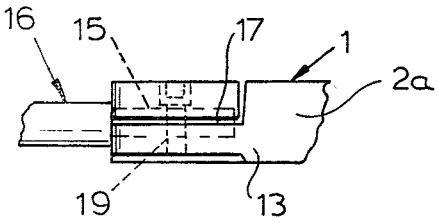
FIG. 6
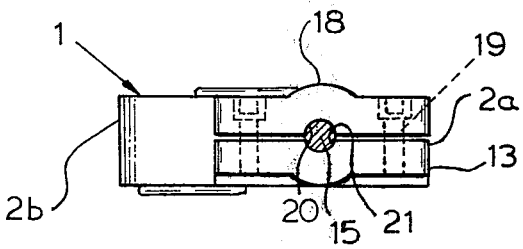
FIG. 5

BATTERY POST CLAMP MEMBER

BACKGROUND OF THE INVENTION

Over the years there have been many battery terminal clamps devised embodying widely varying structural designs. Some have involved bifurcated structures with the clamping pressures applied by means of bolts connecting the free ends, cooperable spring arrangements, camming arrangements and the like.

Clamp structures employing two separate clamping members have also been produced, as for example, such as illustrated in U.S. Pat. No. 2,285,545 dated June 9, 1942 and U.S. Pat. No. 2,020,220 dated Nov. 5, 1935. Both of these employ two camp members, utilizing spring means to provide the clamping forces on a cooperable battery terminal or the like. However, both require tools to effect a disconnection or connection. In the first patent, a screwdriver or similar tool is required, for diposition between the two, free ends of the clamp member adjacent the jaws of the latter, whereby the latter may be separated by twisting the blade of the screwdriver. In the second patent provision is made for engagement with a pair of pliers or the like at the opposite free ends of the clamping member to effect a compression of the actuating spring thereat and to open the jaws.

BRIEF SUMMARY OF THE INVENTION

The present invention is directed to a battery terminal clamping structure which is so designed that it may be mounted or detached without the necessity of tools and which is very simple in construction, employing merely four pieces of simple design, with the construction being such that the jaw members are effectively maintained aligned relation and yet readily capable of being disposed in open relationship to permit disconnection from a terminal or application thereto when desired.

BRIEF DESCRIPTION OF THE DRAWINGS

In the drawings wherein like reference characters indicate like or corresponding parts:

FIG. 1 is a perspective view of a battery clamp constructed in accordance with the present invention, illustrating its mounting on a battery terminal;

FIG. 2 is a side elevational view of the clamp illustrated in FIG. 1;

FIG. 3 is a sectional view taken approximately on the line III—III of FIG. 2;

FIG. 4 is a sectional view taken approximately on the line IV—IV of FIG. 3;

FIG. 5 is an end elevational view of a modified form of the invention having means for clamping a cable thereto; and FIG. 6 is a side elevational view of the embodiment illustrated in FIG. 5.

DETAILED DESCRIPTION OF THE INVENTION

Referring to the drawing and more particularly to FIGS. 1–4, the reference numeral 1 designates a battery terminal clamp comprising a pair of clamping members 2a and 2b adapted to be assembled in side-by-side relation, as illustrated in FIG. 3. The member 2a is provided with a recess 3a therein adjacent one free end thereof and the member 2b is provided with a similar cooperable recess 3b therein, such recesses being disposed in opposed relation and cooperating to define a generally clyindrical bore, adjacent one end of the assembly, adapted to receive a terminal 4 as illustrated in FIG. 1. As it will be apparent from a reference to FIG. 2, battery terminals such as the terminal 4 have a slightly conical configuration with the diameter thereof decreasing slightly from the base end thereof to its free outer end, with the bore formed by the recesses 3a and 3b having a configuration complemental to that of the terminal.

As illustrated in FIG. 3, the members 2a and 2b are adapted to be operatively engaged with connecting means 5 which, in the embodiment illustrated, comprises a relatively thin flat strip member, the ends of which are disposed in respective slots 6a and 6b in the corresponding members 2a and 2b, with the slots having a depth and height of a size approximately equal to the corresponding dimensions of the strip 5, as will be apparent from a reference to FIG. 4.

As illustrated (somewhat exaggerated) in FIG. 3, the dimension of the slot 6a, corresponding to the thickness of the strip 5. is slightly less than the actual thickness of the strip, whereby the strip may be inserted and firmly retained in the slot by means of a press fit. The slot 6b, however, in the member 2b has a corresponding dimension slightly greater than the thickness of the strip to form a sliding connection with the adjacent end thereof.

Each of the members 2a and 2b are provided with a second recess 7a and 7b respectively in their opposed faces which are cooperable to define a second, substantially cylindrical bore in which is disposed the coil portion 8 of a torsion spring 9. As will be apparent from reference to FIGS. 2 and 4, the spring 9 has the respective free ends 10a and 10b thereof extending tangentially from the coil or helical portion 8 thereof, with the extreme free ends of the leg portions terminating in respective transversely extending portions 11a and 11b, which portions extend in opposite directions with the portion 11a thus extending downwardly as viewed in FIG. 4 and the portion 4 be extending upwardly.

The respective members 2a and 2b are provided with respective notches 12a and 12b, for receiving the respective portions 11a, 11b, which notches extend generally parallel to the axis of the bore fromed by the recesses 7a and 7b, with such recesses extending to the top and bottom faces respectively of the members 2a and 2b.

As illustrated in FIGS. 1 and 3, the end of the clamping member 2a, adjacent the spring 9, is enlarged as indicated at 13 with the enlargement being provided with a bore 14 therein for the conductor 15 of a cable, indicated generally by the numeral 16. The conductor 15 can be secured in the portion 13 by any suitable means as for example soldering, swedging or other means.

FIGS. 5 and 6 illustrate a modified form of cable mounting, for example designed for replacement purposes, which is provided with clamping means for securing the conductor of a cable to the cooperable clamp member. In this construction, the portion 13 of the clamp member 2a is enlarged over that illustrated in FIGS. 1 and 2 and is provided with a notch 17 therein, in which is disposed a cooperable clamp member 18, adapted to be secured to the member 13 by suitable screws 19, for example socket cap screws as illustrated, which extend through the member 18 and are threaded into the member 13 as illustrated in FIGS. 5 and 6. As will be apparent from reference to FIG. 5, the portion 13 and cooperable member 18 are provided with opposing semicylindrical recesses 20 and 21 which are cooperable to form a bore for receiving the conductor 15 of the cable 16, and upon tightening of the screws 19, to clamp the conductor 15 to the member 2a. In operation, the end portions of the clamping members 2a and 2b, containing the terminal receiving recesses 3a and 3b, may be pivoted relative to one another about the axis of the torsion spring 9 by the application of compression forces to the portion 13 and adjacent and portion 21 of the clamp member 2b in a direction to bring the two toward one another. Due to the sliding fit between the member 2b and the strip 5, coupled with the inherent resiliency of the strip, the latter may flex as well as slide within the slot 6b, to permit the desired pivotal movement between the two members. However, the strip will effectively prevent twisting movement between the two clamp members during such opening and closing travel.

If desired, the transversely extending portions 11a and 11b of the spring 9 may be extended, as indicated in dotted lines in FIG. 4, to the bottom and top bases respectively of the associated member with the free end thereof bent at right angles thereto and extending substantially parallel to the horizontally extending leg portions 10a and 10b of the spring, thus further insuring the accurate alignment of the two clamping members. In this case the notches 12a and 12b would be accordingly proportioned.

Likewise, it will be appreciated that the spring 9 has been shown, for the purposes of illustration as embodying a relatively large number of turns in the coiled portion 8 thereof. It is believed apparent that the spring may be stiffened, as desired, by reducing the number of coils thereof and increasing the diameter of the spring wire from which the same is fabricated. In some cases, it may be adequate to utilize a torsion spring having no turns or coils. In this construction, the spring would be of sufficient diameter to provide the desired torsion forces in the central portion thereof connecting the leg portions 10a and 10b, and the bore formed by recesses 7a, 7b would be accordingly proportioned.

It will be appreciated that the present invention provides a relatively very simple construction requiring no screws, nuts, or other loose pieces and incorporating merely four cooperable parts, the members 2a and 2b, strip 5, and spring 9.

Although I have described my invention by reference to particular illustrative embodiments, many changes and modifications of the invention may become apparent to those skilled in the art without departing from the spirit and scope of the invention. I therefore intend to include within the patent warranted hereon all such changes and modifications as may reasonable and properly be included within the scope of my contribution to the art.

I claim as my invention:

1. A battery connector, for connecting a battery cable to a battery terminal, comprising a pair of cooperable clamp members disposed in side-by-side non-crossing relation, each having a recess in its opposing face, each of said recesses being generally semicylindrical and aligned to form a generally cylindrical bore in the assembled structure, a torsion spring comprising a coiled helical portion terminating at its ends in tangentially extending leg portions, said spring having its coiled portion thereof disposed in said bore with each leg portion disposed adjacent to and engaged with a respective clamp member for inserting forces on said clamp members to retain said clamp members in assembled relation, each of said clamp members having a further recess therein, disposed to form cooperable terminal-engaging portions adapted to clamp a battery terminal therebetween and connecting means connecting said clamp members at opposed faces, intermediate said spring recesses and said terminal engaging recesses, said connecting means being fixedly carried by one of said clamp members and slidably engaging the other of said clamp members for maintaining said members in operative aligned relation but permitting separating movement thereof, one of said clamp members having means thereon for the reception and securing of the conductor of a battery cable, said connecting means comprising a relatively thin flat metallic strip having a pair of ends, and said clamp members including respective slots receiving said flat metallic strip, said slots being so designed that said strip is received in one of said slots by a press fit and is slidable in the other of said slots.

2. A battery connector, for connecting a battery cable to a battery terminal, comprising a pair of cooperable clamp members disposed in side-by-side relation, each of said clamp members having adjacent their respective opposing ends, and in an opposing face thereof, a recess therein, disposed to form cooperable terminal-engaging portions adapted to clamp a battery terminal therebetween, and connecting means connecting said clamp member at said opposed faces, adjacent said terminal engaging recesses, said means being fixedly carried by one of said clamp members and slidably engaging the other of said clamp members for maintaining said members in operative aligned relation, but permitting separate movement thereof, and spring means operatively connecting said clamp members for applying forces thereto for urging said terminal engaging portions in clamping directions and retaining said clamping members in an assembled relation, one of said members having means thereon for receiving and securing the conductor of a battery cable, said connecting means comprising a relatively thin flat metallic strip having a pair of ends, said clamp members including respective slots receiving respective ends of said flat metallic strip, one of said slots receiving one of said ends of said strip in a press fit and the other of said slots slidably receiving the other end of said flat metallic strip.

3. A clamp member according to claim 2, wherein said cable receiving means comprises a bore in the associated clamp member forming a socket for receiving a conductor and for securing the conductor therein.

4. A clamp member according to claim 2, wherein said cable receiving means comprises a clamp element cooperable with the associated clamp member for receiving a conductor therebetween, and means for exerting clamping pressure on the conductor disposed therebetween.

* * * * *